US008424125B2

(12) United States Patent
Anderson

(10) Patent No.: US 8,424,125 B2
(45) Date of Patent: Apr. 23, 2013

(54) URINAL ATTACHMENT

(76) Inventor: Andrea Marie Anderson, Sturgis, SD (US)

( * ) Notice: Subject to any disclaimer, the term of this patent is extended or adjusted under 35 U.S.C. 154(b) by 521 days.

(21) Appl. No.: 12/792,022

(22) Filed: Jun. 2, 2010

(65) Prior Publication Data

US 2011/0296602 A1 Dec. 8, 2011

(51) Int. Cl.
*E03D 1/22* (2006.01)

(52) U.S. Cl.
USPC ..... 4/342; 4/301; 4/144.1

(58) Field of Classification Search ..... 4/342, 144.1–144.4, 301, 114.1, 4/340, 341, 231, 246.1
See application file for complete search history.

(56) References Cited

U.S. PATENT DOCUMENTS 3,822,419 A * 7/1974 Wilson, Sr. ..... 4/144.4
5,737,779 A * 4/1998 Haddock ..... 4/301
7,228,572 B1 * 6/2007 Holden ..... 4/144.1

* cited by examiner

*Primary Examiner* — Gregory Huson
*Assistant Examiner* — Christine Skubinna
(74) *Attorney, Agent, or Firm* — Clement Cheng

(57) ABSTRACT

A urinal attachment for a toilet bowl has a flow diverter with a receptacle bowl at a top end of the flow diverter. The receptacle bowl leads to a receptacle neck which leads to a receptacle elbow which leads to a first vertical tube in telescopic connection with a second vertical tube. The second vertical tube leads to an outlet. A bowl connector portion includes a front shield bracket connecting the flow diverter to a rim of the toilet bowl. The bracket includes a rim connector having a vertical rim member, a horizontal rim member and a rim scoop. The rim scoop has a select convex shape and a front shield with a bottom rim. The front shield has a convex shape.

16 Claims, 4 Drawing Sheets

URINAL ATTACHMENT

FIELD OF THE INVENTION

The present invention is in the appeal of urinal attachment devices.

DISCUSSION OF RELATED ART

A variety of urinal attachments have been made for converting a toilet bowl into a urinal. For example in Whitman U.S. Pat. No. 4,612,676, issued Sep. 23, 1986, the disclosure of which is incorporated herein by reference, Whitman discloses a urinal attachment for a toilet having a low container like body. Other attachments have operated like splash guards, such as in U.S. Pat. No. 2,980,919 issued April 1961 to Otto, the disclosure of which is incorporated herein by reference.

A swiveling attachment is shown in U.S. Pat. No. 5,153,946 to Markles issued Oct. 13, 1992, the disclosure of which is incorporated herein by reference. Miuccio in U.S. Pat. No. 5,819,331 discloses an attachment located in the underside of the lid, the disclosure of which is incorporated herein by reference. A bracket arm as described in U.S. Pat. No. 4,282,611 to O'Day provides storage and adjustability of the attachment.

The current state-of-the-art can be improved with additional enhancements in the field of urinal attachment devices.

SUMMARY OF THE INVENTION

A urinal attachment for a toilet bowl has a flow diverter with a receptacle bowl at a top end of the flow diverter. The receptacle bowl leads to a receptacle neck which leads to a receptacle elbow which leads to a first vertical tube in telescopic connection with a second vertical tube. The second vertical tube leads to an outlet. A bowl connector portion includes a front shield bracket connecting the flow diverter to a rim of the toilet bowl. The bracket includes a rim connector having a vertical rim member, a horizontal rim member and a rim scoop. The rim scoop has a select convex shape and a front shield with a bottom rim. The front shield has a convex shape.

The urinal attachment also has a front shield shaped with a pair of front shield bottom tips extending from the front shield bottom rim. The front shield bottom rim has an arc shape, and the front shield has a generally curved front shield face, so that a left edge and a right edge of the front shield face initially curve forward, and then backward from an upper portion of the front shield face to a lower portion of the front shield face.

The front shield bracket extends horizontally from a top portion of the front shield face. The front shield bracket has a pair of bracket slots extending backward from the front shield along a top surface of the front shield bracket, and the bracket slots receive a pair of bracket connectors for connection between the vertical rim member and the bracket slots. The bracket has a rectangular profile beginning from a distance half of the diameter of the second vertical tube, and a rear rectangular edge of the bracket extends from the outside surface of the second vertical tube. The bracket extends from the second vertical tube in an orthogonal sideways direction and in an orthogonal front direction.

A horizontal rim member extends from a lower portion of a vertical rim member, and the horizontal rim member bends from the vertical rim member and terminates at a front edge. The rim scoop protrudes upwardly from the front edge of the horizontal rim member. The receptacle bowl has a forward receptacle tip and an upward sloping profile, and the receptacle bowl has a receptacle rim formed in an oval profile around the receptacle bowl. The receptacle bowl further includes an upper receptacle tip at a higher level than the forward receptacle tip. The vertical tube adjustment grip allows rotation of the vertical tube collar. The vertical tube adjustment grip is formed as a plurality of vertically disposed ridge protrusions between a plurality of vertically disposed channel indentations. Rotation of the vertical tube collar selectively secures the vertical tube collar with the first vertical tube to allow height adjustment of the receptacle bowl.

The first vertical tube is an inside vertical tube of a first diameter, and wherein the second vertical tube is an outside vertical tube of a second diameter. The first diameter is smaller than the second diameter, and the inside vertical tube is preferably in telescopic adjustable configuration with the outside vertical tube.

Figure 1:
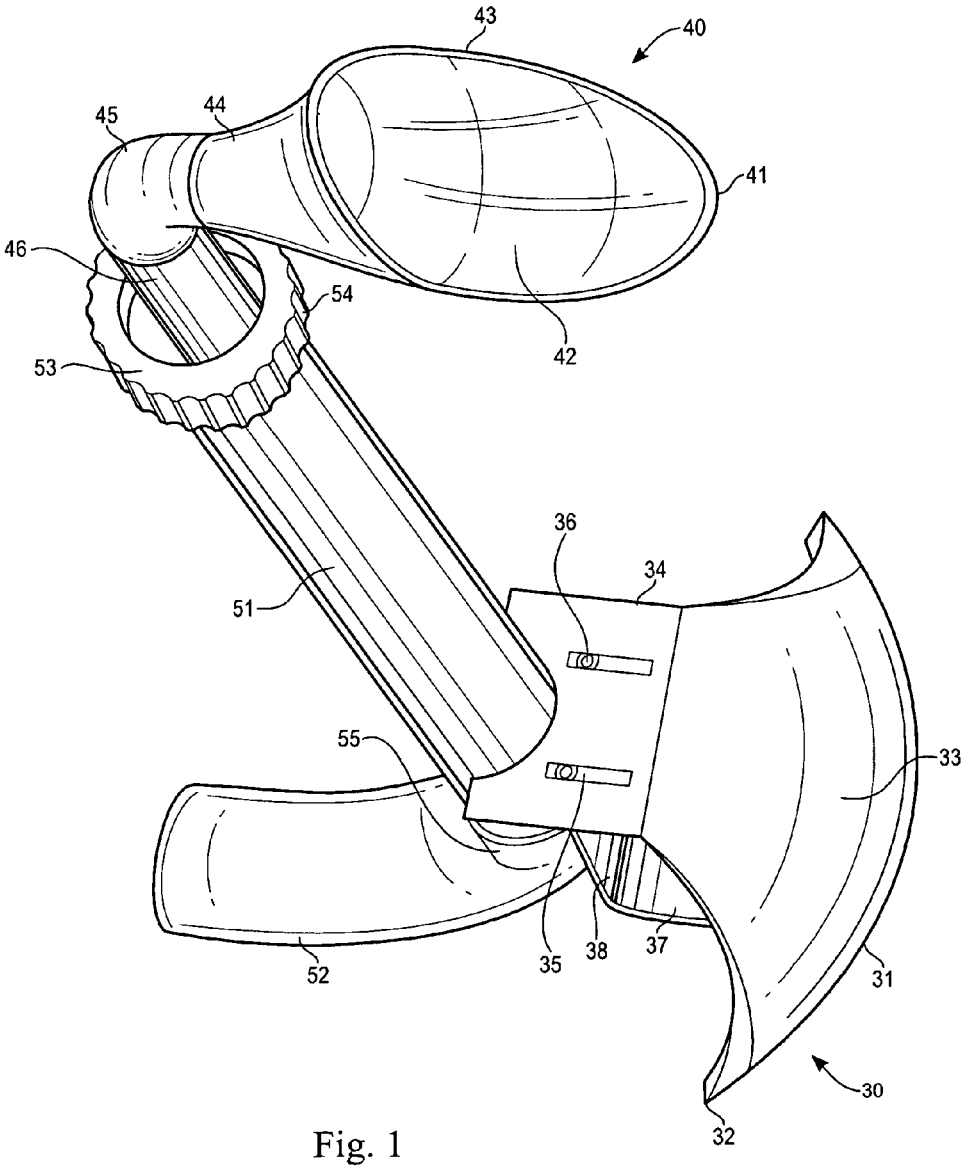
FIG. 1 is a top left perspective view of the present invention.
Figure 2:
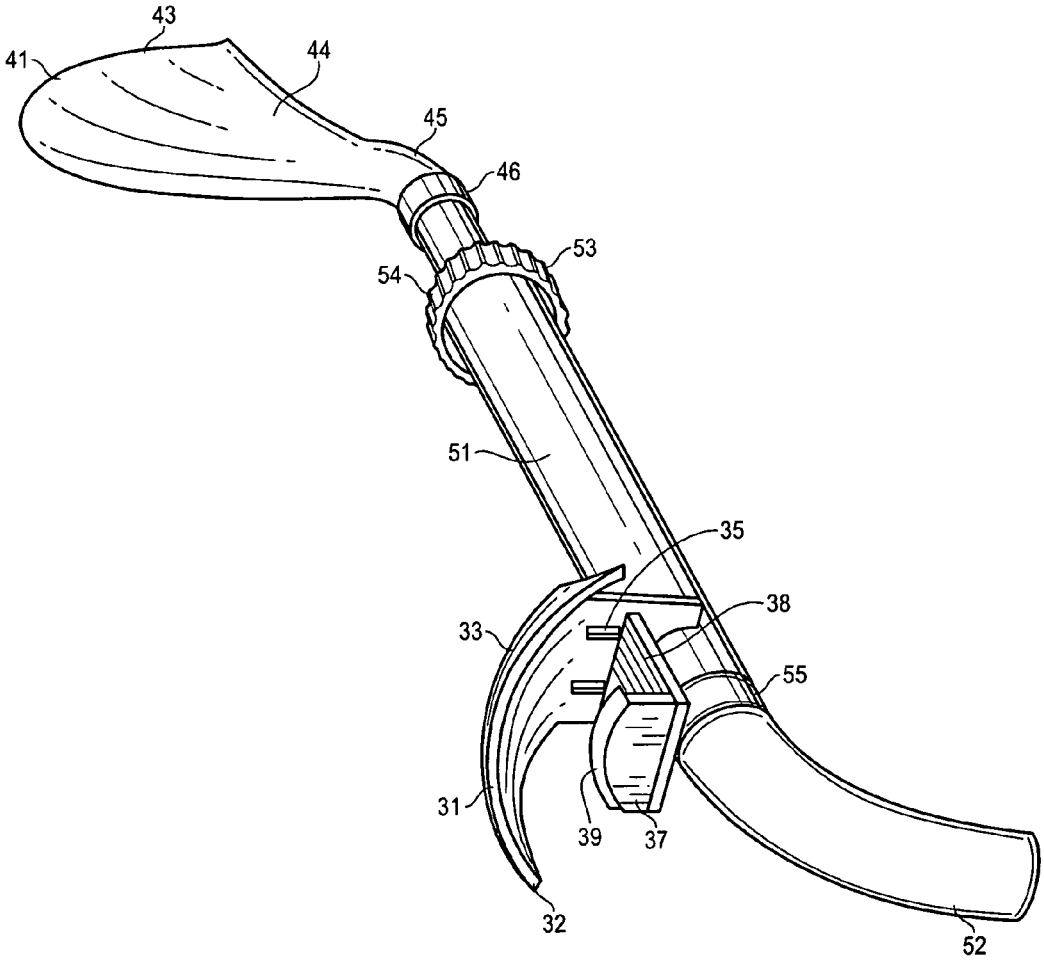
FIG. 2 is a bottom right perspective view.
Figure 3:
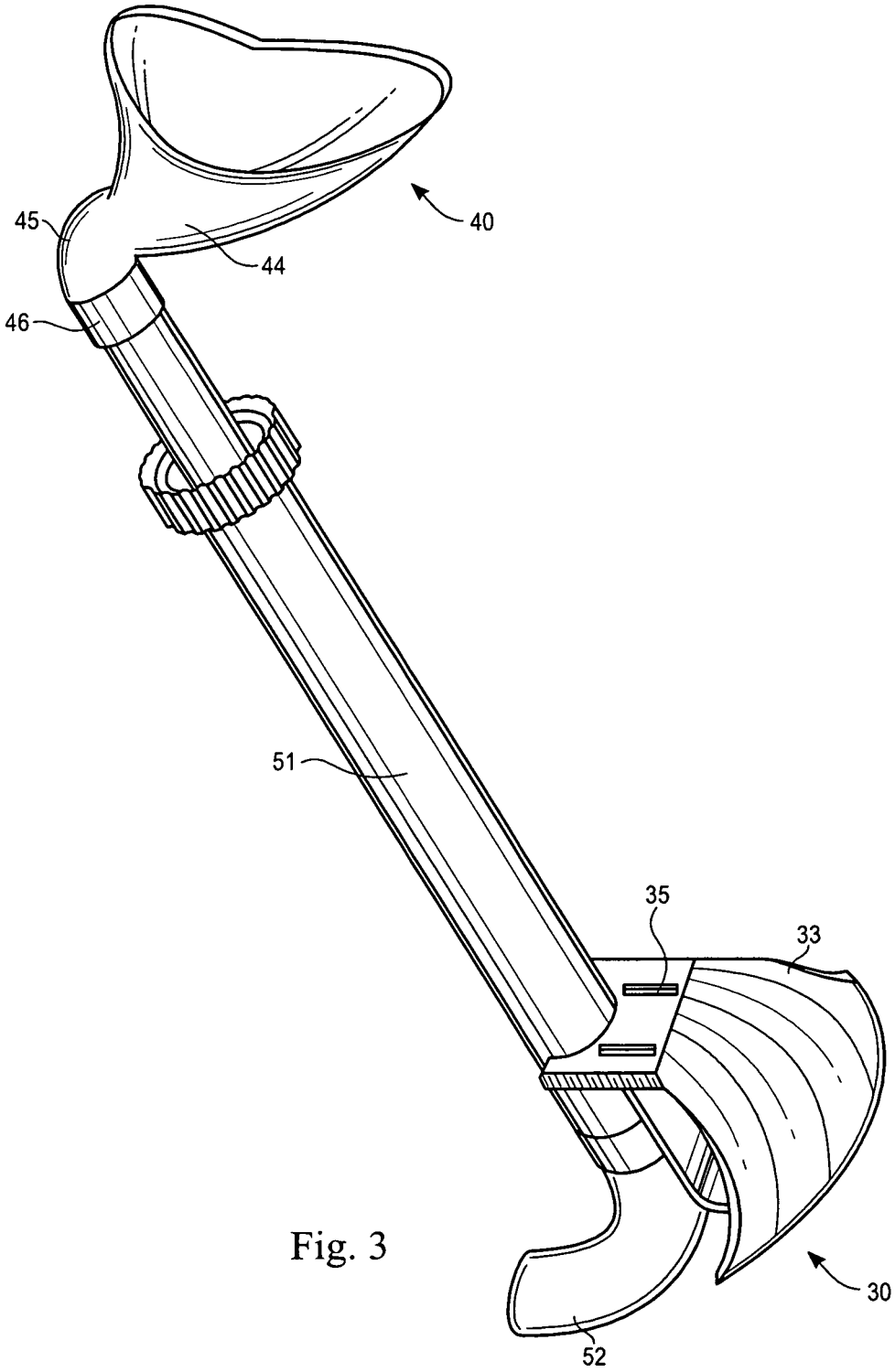
FIG. 3 is a top left perspective view.
Figure 4:
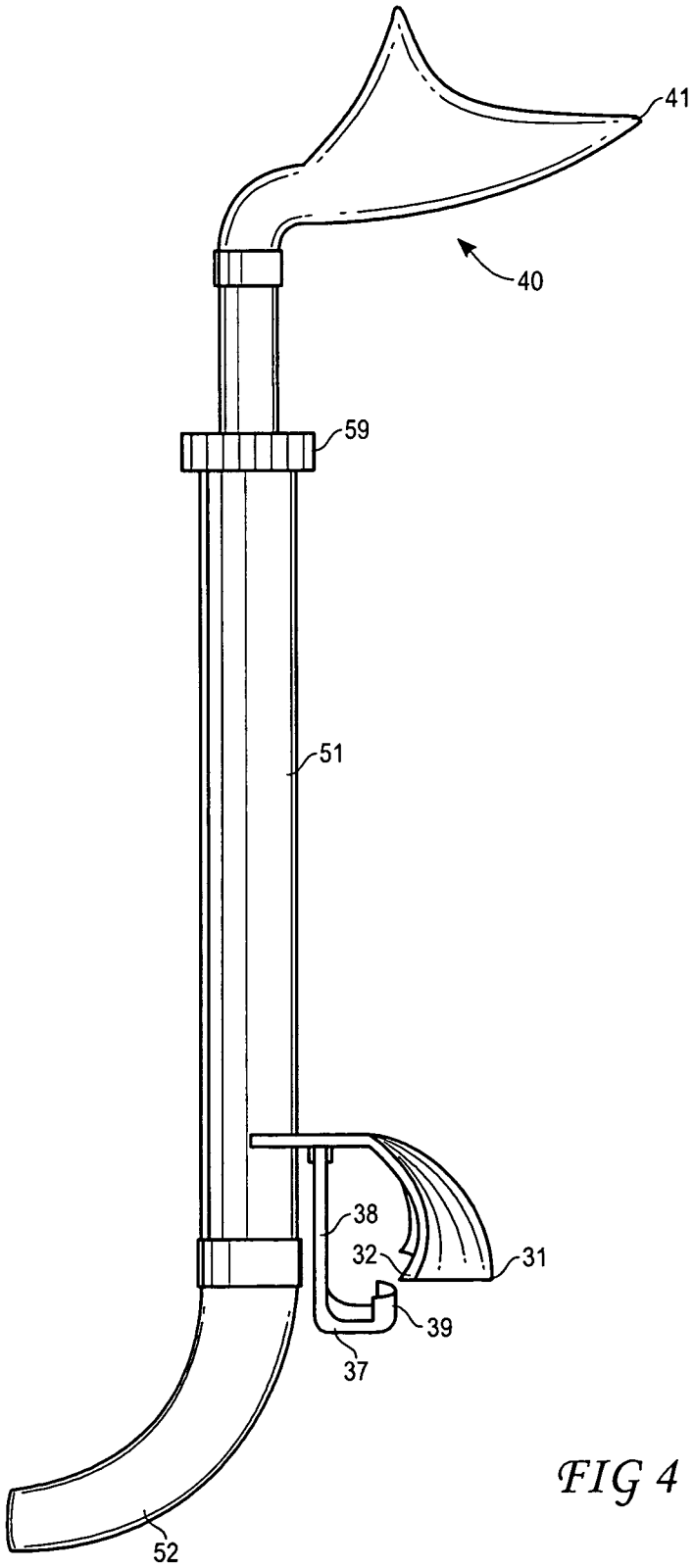
FIG. 4 is a left view of the present invention.

The following call outs may be useful in understanding the invention and referencing the elements of the drawings.

30 Front Shield
31 Front Shield Bottom Rim
32 Front Shield Bottom Tip
33 Front Shield Face
34 Front Shield Bracket
35 Bracket Slot
36 Bracket Connector
37 Horizontal Rim Member
38 Vertical Rim Member
39 Rim Scoop
40 Receptacle
41 Receptacle Tip
42 Receptacle Bowl
43 Receptacle Rim
44 Receptacle Neck
45 Receptacle Elbow
46 Inside Vertical Tube
51 Outside Vertical Tube
52 Vertical Tube Outlet
53 Vertical Tube Collar
54 Vertical Tube Adjustment Grip
55 Vertical Tube Elbow

DETAILED DESCRIPTION OF THE PREFERRED EMBODIMENT

The present invention is a toilet bowl attachment for converting a bowl configuration to a urinal configuration for the assistance of a variety of disabled or handicapped persons. The attachment is a flow diverter that has a telescopic height adjusted receptacle for flow. A bracket connects the flow diverter to a toilet.

A front shield 30 is shaped to conform to a toilet bowl outer surface and has a front shield bottom rim 31 and a pair of front shield bottom tips 32. The front shield bottom rim 31 has an arc shape terminated at a pair of opposing front shield bottom tips 32. Preferably, the front shield bottom tips 32 support against the bowl outer surface. The front shield has a generally curved front shield face 33. A front shield bracket 34 extends horizontally from the top portion of the front shield face 33. The left and right edges of the front shield face 33 initially curve forward, and then backward from an upper portion of the front shield face 33 to a lower portion of the front shield face 33.

The front shield bracket 34 has a pair of bracket slots 35 through which bracket connectors 36 are disposed. The bracket connectors 36 can be formed as machine screws made of plastic or metal or snaps for connection to a vertical rim member 38. The vertical rim member 38 can be adjusted forward and backward along the bracket slots 35. The bracket slots 35 are disposed along a forward and backward direction. The bracket connector can be formed as machine screws that thread through a top surface of the bracket slot 35 and down into the vertical rim member 38.

The bracket preferably has a rectangular profile beginning from a distance half of the diameter of the outside vertical tube 51. A rear rectangular edge of the bracket is molded to, integral formed with, or otherwise bonded or attached to the outside surface of the outside vertical tube 51. The bracket extends from the outside vertical tube 51 in an orthogonal sideways direction and in an orthogonal front direction. The bracket is preferably formed as a plate of plastic. The bracket preferably has the same thickness or greater thickness than the front shield 30.

A horizontal rim member 37 extends from the lower portion of the vertical rim member 38. Preferably, the horizontal rim member 37 curves from the vertical rim member 38, but could also be joined in a right angle at a rear edge of the horizontal rim member. The horizontal rim member 37 has a front edge terminating at a rim scoop 39. The rim scoop 39 is curved to follow the inside surface of a bowl. The rim scoop 39 can have an edge or elastomeric front engagement surface. The rim scoop 39 protrudes upwardly from the front edge of the horizontal rim member 37.

The receptacle 40 receives a flow and has a forward receptacle tip 41. The receptacle bowl 42 slopes upward in an arc shaped form. The receptacle rim 43 is preferably formed as an oval profile around the receptacle bowl. At a rear end of the receptacle bowl 42, a receptacle neck 44 leads to a receptacle elbow 45. The receptacle elbow has a bend of approximately preferably a right angle and leads to an inside vertical tube 46 of a first diameter. The receptacle elbow 45 terminates at a downward opening which receives an inside vertical tube 46. The outside surface of the inside vertical tube 46 can be interference fit into an inside surface of the receptacle elbow 45. Optionally, the inside vertical tube 46 can be permanently secured to the receptacle elbow 45, such as by epoxy glue, by mechanical connection, or by sonic welding.

The inside vertical tube 46 telescopic connects with outside vertical tube 51. Optionally, a vertical tube adjustment grip 54 allows rotation of the vertical tube collar 53. The vertical tube adjustment grip 54 is formed as a plurality of vertically disposed ridge protrusions between a plurality of vertically disposed channel indentations. The vertical tube collar 53 can be mechanically connected to the inside vertical tube so that rotation of the vertical tube collar 53 selectively secures the vertical tube collar 53 with the inside vertical tube 46 so that a user can adjust the height of the receptacle bowl. A connector can engage the inside of the vertical tube collar to the outside surface of the inside vertical tube when the vertical tube adjustment grip 54 is rotated. Rotation of the vertical tube adjustment grip 54 in an opposite and disengaging direction can release the inside vertical tube 46 from the vertical tube collar 53.

The outside vertical tube 51 leads to a vertical tube elbow 55 that is angled backward. The backward angled vertical tube elbow 55 leads to the vertical tube outlet 52 at a rear bottom portion of the attachment device. The outlet 52 is formed as a curved tube having a radius of curvature and beginning with a vertical opening connected to the outside vertical tube and ending at an outlet opening of the outlet member that is horizontally disposed.

A side view of the present invention provides a view of the forward receptacle tip 41 that extends from the receptacle 40. The receptacle 40 further includes an upward tip extending above the forward receptacle tip 41. A concave profile is established between the forward receptacle tip 41 and the upward tip of the receptacle.

The invention claimed is:

1. A urinal attachment for a toilet bowl comprising:

a. a flow diverter having a receptacle bowl at a top end of the flow diverter, wherein the receptacle bowl leads to a receptacle neck which leads to a receptacle elbow which leads to a first vertical tube in telescopic connection with a second vertical tube, wherein the second vertical tube leads to an outlet;

b. a bowl connector portion including a front shield bracket connecting the flow diverter to a rim of the toilet bowl, wherein the bracket comprises a rim connector having a vertical rim member, a horizontal rim member and a rim scoop, wherein the rim scoop has a convex shape; and c. a front shield comprising a bottom rim, wherein the front shield is a convex shape.

2. The urinal attachment of claim 1, wherein the front shield is shaped with a pair of front shield bottom tips extending from the front shield bottom rim, wherein the front shield bottom rim has an arc shape, wherein the front shield has a generally curved front shield face, wherein a left edge and a right edge of the front shield face initially curve forward, and then backward from an upper portion of the front shield face to a lower portion of the front shield face.

3. The urinal attachment of claim 1, wherein the front shield bracket extends horizontally from a top portion of the front shield face.

4. The urinal attachment of claim 1, wherein the front shield bracket has a pair of bracket slots extending backward from the front shield along a top surface of the front shield bracket, wherein the bracket slots receive a pair of bracket connectors for connection between the vertical rim member and the bracket slots.

5. The urinal attachment of claim 1, wherein the bracket has a rectangular profile beginning from a distance half of the diameter of the second vertical tube, wherein a rear rectangular edge of the bracket extends from the outside surface of the second vertical tube, wherein bracket extends from the second vertical tube in an orthogonal sideways direction and in an orthogonal front direction.

6. The urinal attachment of claim 1, wherein a horizontal rim member extends from a lower portion of a vertical rim member, wherein the horizontal rim member bends from the vertical rim member and terminates at a front edge, wherein the rim scoop protrudes upwardly from the front edge of the horizontal rim member.

7. The urinal attachment of claim 1, wherein the receptacle bowl has a forward receptacle tip and an upward sloping profile, wherein the receptacle bowl has a receptacle rim formed in an oval profile around the receptacle bowl, wherein the receptacle bowl further includes an upper receptacle tip at a higher level than the forward receptacle tip.

8. The urinal attachment of claim 1, further comprising a vertical tube adjustment grip for rotation of the vertical tube collar, wherein the vertical tube adjustment grip is formed as a plurality of vertically disposed ridge protrusions between a plurality of vertically disposed channel indentations, wherein rotation of the vertical tube collar selectively secures the vertical tube collar with the first vertical tube to allow height adjustment of the receptacle bowl.

9. The urinal attachment of claim 1, wherein the first vertical tube is an inside vertical tube of a first diameter, and wherein the second vertical tube is an outside vertical tube of a second diameter, wherein the first diameter is smaller than the second diameter, wherein the inside vertical tube is in telescopic adjustable configuration with the outside vertical tube.

10. The urinal attachment of claim 9, wherein the front shield is shaped with a pair of front shield bottom tips extending from the front shield bottom rim, wherein the front shield bottom rim has an arc shape, wherein the front shield has a generally curved front shield face, wherein a left edge and a right edge of the front shield face initially curve forward, and then backward from an upper portion of the front shield face to a lower portion of the front shield face.

11. The urinal attachment of claim 9, wherein the front shield bracket extends horizontally from a top portion of the front shield face.

12. The urinal attachment of claim 9, wherein the front shield bracket has a pair of bracket slots extending backward from the front shield along a top surface of the front shield bracket, wherein the bracket slots receive a pair of bracket connectors for connection between the vertical rim member and the bracket slots.

13. The urinal attachment of claim 9, wherein the bracket has a rectangular profile beginning from a distance half of the diameter of the second vertical tube, wherein a rear rectangular edge of the bracket extends from the outside surface of the second vertical tube, wherein bracket extends from the second vertical tube in an orthogonal sideways direction and in an orthogonal front direction.

14. The urinal attachment of claim 9, wherein a horizontal rim member extends from a lower portion of a vertical rim member, wherein the horizontal rim member bends from the vertical rim member and terminates at a front edge, wherein the rim scoop protrudes upwardly from the front edge of the horizontal rim member.

15. The urinal attachment of claim 9, wherein the receptacle bowl has a forward receptacle tip and an upward sloping profile, wherein the receptacle bowl has a receptacle rim formed in an oval profile around the receptacle bowl, wherein the receptacle bowl further includes an upper receptacle tip at a higher level than the forward receptacle tip.

16. The urinal attachment of claim 9, further comprising a vertical tube adjustment grip for rotation of the vertical tube collar, wherein the vertical tube adjustment grip is formed as a plurality of vertically disposed ridge protrusions between a plurality of vertically disposed channel indentations, wherein rotation of the vertical tube collar selectively secures the vertical tube collar with the first vertical tube to allow height adjustment of the receptacle bowl.

* * * * *